US007173379B2

(12) United States Patent
Ball

(10) Patent No.: US 7,173,379 B2
(45) Date of Patent: Feb. 6, 2007

(54) INCREMENTAL DISTRIBUTED DRIVER

(75) Inventor: Newton E. Ball, Anaheim, CA (US)

(73) Assignee: Microsemi Corporation, Irvine, CA (US)

( * ) Notice: Subject to any disclaimer, the term of this patent is extended or adjusted under 35 U.S.C. 154(b) by 8 days.

(21) Appl. No.: 11/181,505

(22) Filed: Jul. 14, 2005

(65) Prior Publication Data

US 2006/0022610 A1 Feb. 2, 2006

Related U.S. Application Data

(60) Provisional application No. 60/592,700, filed on Jul. 30, 2004.

(51) Int. Cl.
*H05B 37/02* (2006.01)

(52) U.S. Cl. ..... 315/213; 315/220; 315/221; 315/224; 315/226; 315/300

(58) Field of Classification Search ..... 315/209 R, 315/210, 211, 212, 213, 219, 220, 221, 224–226, 315/301, 302, 299, 300, 307, 312, 320, 324, 315/222, 291
See application file for complete search history.

(56) References Cited

U.S. PATENT DOCUMENTS

| | | | | |
|---|---|---|---|---|
| 4,388,562 | A | 6/1983 | Josephson | 315/205 |
| 4,698,554 | A | 10/1987 | Stupp | 315/307 |
| 5,621,281 | A | 4/1997 | Kawabata et al. | 315/311 |
| 6,028,400 | A * | 2/2000 | Pol et al. | 315/225 |
| 6,104,146 | A | 8/2000 | Chou et al. | 315/277 |
| 6,215,256 | B1 | 4/2001 | Ju | 315/307 |
| 6,310,444 | B1 | 10/2001 | Chang | 315/282 |
| 6,420,839 | B1 | 7/2002 | Chiang et al. | 315/311 |
| 6,459,216 | B1 * | 10/2002 | Tsai | 315/294 |
| 6,472,876 | B1 | 10/2002 | Notohamiprodjo et al. | 324/414 |
| 6,486,618 | B1 | 11/2002 | Li | 315/291 |
| 6,494,587 | B1 | 12/2002 | Shaw et al. | 362/29 |
| 6,501,234 | B2 | 12/2002 | Lin et al. | 315/307 |
| 6,509,696 | B2 | 1/2003 | Bruning et al. | 315/246 |
| 6,630,797 | B2 | 10/2003 | Qian et al. | 315/224 |
| 6,717,372 | B2 | 4/2004 | Lin et al. | 315/282 |
| 6,803,901 | B1 | 10/2004 | Numao | 345/102 |
| 6,856,099 | B2 * | 2/2005 | Chen et al. | 315/224 |
| 6,936,975 | B2 * | 8/2005 | Lin et al. | 315/224 |
| 6,947,024 | B2 * | 9/2005 | Lee et al. | 345/102 |
| 2004/0017348 | A1 | 1/2004 | Numao | 345/92 |
| 2005/0062436 | A1 * | 3/2005 | Jin | 315/244 |

* cited by examiner

*Primary Examiner*—Thuy Vinh Tran
(74) *Attorney, Agent, or Firm*—Knobbe, Martens, Olson & Bear, LLP.

(57) ABSTRACT

An incremental distributed driver divides power delivered to multiple lamps into two power delivery stages. The first power delivery stage operates in voltage-mode to provide a partial operating voltage to the lamps. The second power delivery stage operates in current-mode to regulate current levels for each of the lamps and to provide additional operating voltages for the respective lamps. Each of the power delivery stages includes a polarity-switching network and a common set of driving signals from a controller can be used to drive the polarity-switching networks of both power delivery stages. The first power delivery stage delivers a majority of the power to the lamps and the second power delivery stage facilitates control of individual lamps while providing the remaining power to the lamps.

20 Claims, 2 Drawing Sheets

INCREMENTAL DISTRIBUTED DRIVER

CLAIM FOR PRIORITY

This application claims the benefit of priority under 35 U.S.C. § 119(e) of U.S. Provisional Application No. 60/592,700, filed on Jul. 30, 2004, and entitled "Incremental Distributed Driver," the entirety of which is incorporated herein by reference.

BACKGROUND

1. Field of the Invention

The invention generally relates to a driver circuit in a backlight system for powering multiple lamps, and more particularly, relates to an inverter that delivers power to the multiple lamps in incremental stages to facilitate control of individual lamps.

2. Description of the Related Art

The quality of a liquid crystal display (LCD) backlit by lamps (e.g., cold cathode fluorescent lamps or CCFLs) is enhanced by sequential blanking (or turning off) of one or more of the lamps in synchronism with a vertical sweep of a display image. The lamps are generally powered by direct current (DC) to alternating current (AC) conversion circuits (or inverters). A separate inverter and associated controller are typically used for each bank of lamps (e.g., group of four lamps) to be blanked together.

SUMMARY

In one embodiment, the present invention proposes an efficient incremental distributed driver (or inverter) that drives multiple lamps in a backlight system and facilitates selective blanking (or turning off) of individual or groups of lamps. The incremental distributed driver advantageously uses one controller to control power to the multiple lamps and to accomplish sequential blanking of one or more lamps. In one embodiment, the controller is realized with one or two integrated circuits.

In one embodiment, the incremental distributed driver divides power delivered to the multiple lamps (or lamp loads) into incremental (e.g., two) stages. The first stage (or shared stage) is common to all of the lamps and operates in voltage-mode to provide a partial operating voltage to the lamps. The partial operating voltage by itself is not sufficient to light the lamps (or cause significant current to flow in the lamps). In one embodiment, the first stage delivers a majority of the power (e.g., about 75% or approximately 70–85% of the operating power) to the lamps. The second stage (or distributed stage) operates in current-mode to control (or regulate) current levels for each of the lamps and to provide additional (or incremental) operating voltages to the respective lamps to achieve corresponding desired current levels. The combinations of the partial operating voltage and the additional operating voltages are sufficient to light the respective lamps. For example, the second stage delivers the remaining power (e.g., about 25% or approximately 15–30% of the operating power) through separate current-controlled drives for the respective lamps.

In one embodiment, the first stage (or voltage-mode power stage) includes a first polarity-switching network coupled to a voltage transformer. The second stage (or current-mode power stage) includes a second polarity-switching network coupled to a plurality of balancing transformers. Each of the balancing transformers is associated with a different lamp. The first polarity-switching network and the second polarity-switching network can be advantageously controlled by a common set of driving signals from a controller. For example, the first polarity-switching network includes at least two semiconductor switches arranged in a push-pull topology, a half-bridge topology or a full-bridge topology to couple a substantially DC voltage source in alternating polarities across a primary side of the voltage transformer. The second polarity-switching network includes at least another two semiconductor switches arranged in half-bridge or a full-bridge topology to coupled a substantially DC current source in alternating polarities to serially-connected primary windings of the balancing transformers. In one embodiment, the second stage further includes a current regulator for generating the substantially DC current source from a voltage supply (e.g., the substantially DC voltage source) and brightness of the lamps can be adjusted by varying the level of substantially DC current source at an output of the current regulator.

In one embodiment, the common set of driving signals operate at approximately 50% duty cycle to control the semiconductor switches of the first polarity-switching network and the semiconductor switches of the second polarity-switching network. Thus, the semiconductor switches of the first polarity-switching network alternately conduct to generate the partial operating voltage across a secondary winding of the voltage transformer. The secondary winding of the voltage transformer has a first terminal coupled to first ends of the lamps and a second terminal coupled to an intermediate node. The semiconductor switches of the second polarity-switching network alternately conduct to generate an AC current signal (or common AC driving current) conducted by the primary (or first) windings of the balancing transformers. The balancing transformers have the primary windings coupled in series and secondary (or second) windings separately coupled between the intermediate node and respective second ends of the lamps. In one embodiment, the primary windings of the balancing transformers are a single turn each. The secondary windings of the balancing transformers provide the respective additional operating voltages for the lamps.

Connecting of the primary windings of the balancing transformers in series facilitates current balancing or matching. For example, the currents conducted by the lamps (or the secondary windings of the balancing transformers) follow the AC current signal conducted by the primary windings of the balancing transformers with proportional amplitudes determined by respective transformer turns ratios. In one embodiment, the balancing transformers have approximately equal transformer turns ratios and the lamps conduct approximately equal currents.

The current-mode power stage can advantageously control on/off states of the lamps individually. In one embodiment, each of the balancing transformers includes a third winding and the incremental distributed driver further includes a bank of shorting switches to selectively short one or more of the third windings to turn off the associated lamps. For example, a different pair of semiconductor switches (e.g., N-type field-effect-transistors) is coupled between a reference node (e.g., circuit ground) and respective opposite terminals of each third winding. Power is delivered to light the lamp when its associated pair of semiconductor switches is inactive (or off) and the third winding is floating (or open-circuit). The third winding is short-circuited (or electrically shorted) when its associated pair of semiconductor switches is active (or on) and the additional operating voltage provided by the corresponding secondary winding of the balancing transformer is reduced to approximately zero to effectively turn off the associated lamp. In one embodiment, the third windings are approximately 1–24 turns each and the semiconductor switches used in the bank of shorting switches are relatively low power and low voltage devices. For example, the power switched by each of the semiconductor switches is approximately 1.5 watts, and the voltage across each of the semiconductor switches is in a range of 5–24 volts.

In one embodiment, the lamps are arranged horizontally in a backlight panel to illuminate a LCD and the lamps are sequentially turned off (or blanked) in synchronism with a vertical sweep of display image down a screen of the LCD. The blank state can proceed down the screen (or face) of the LCD in increments of a single lamp or multiple lamps (e.g., four lamps). The sequential blanking of lamps can be controlled by a dimming controller that periodically sends a digital word to control the bank of shorting switches.

In one embodiment, the lamps are periodically turned off to reduce brightness of the lamps. For example, the lamps can be dimmed by turning off for a predetermined time during each half cycle of the driving signals for the first polarity-switching network and the second polarity-switching network. Alternately, the lamps can be dimmed by periodically turning off for a predetermined number of cycles of the driving signals. The current-mode power stage allows the brightness of each lamp to be adjusted separately. Thus, the brightness of each lamp can be adjusted in accordance with an average brightness of LCD pixels in that part of the screen for image enhancement.

For purposes of summarizing the invention, certain aspects, advantages and novel features of the invention have been described herein. It is to be understood that not necessarily all such advantages may be achieved in accordance with any particular embodiment of the invention. Thus, the invention may be embodied or carried out in a manner that achieves or optimizes one advantage or group of advantages as taught herein without necessarily achieving other advantages as may be taught or suggested herein.

BRIEF DESCRIPTION OF THE DRAWINGS

These drawings and the associated description herein are provided to illustrate embodiments and are not intended to be limiting.

DETAILED DESCRIPTION OF EMBODIMENTS

Although particular embodiments are described herein, other embodiments, including embodiments that do not provide all of the benefits and features set forth herein, will be apparent to those of ordinary skill in the art.

Figure 1A:
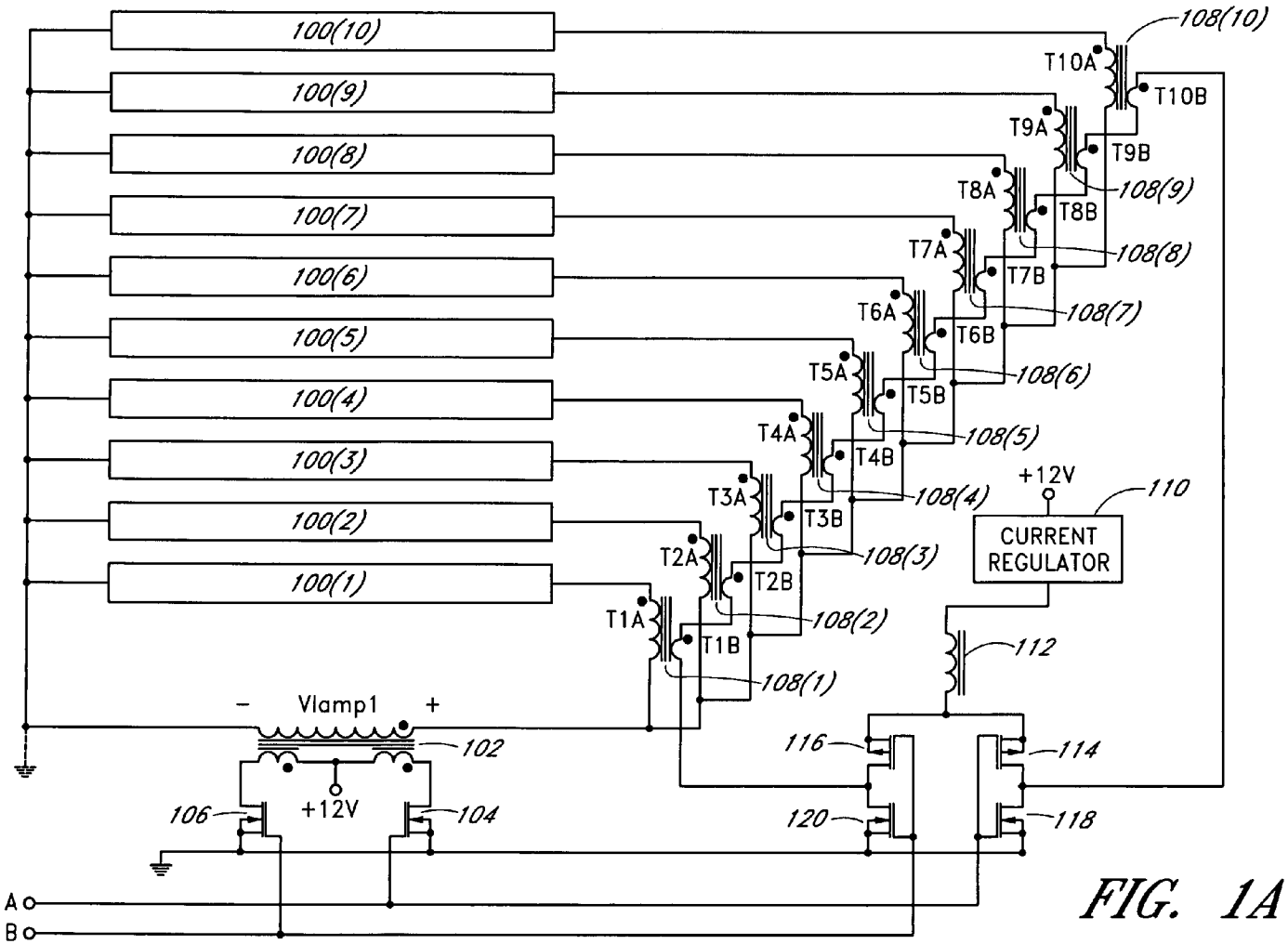
FIG. 1A illustrates one embodiment of an incremental distributed driver.

FIG. 1A illustrates one embodiment of an incremental distributed driver that delivers power to a plurality of lamp loads shown as lamp loads 100(1)–100(10) (collectively the lamp loads 100) using two (or incremental) control stages. Each of the lamp loads 100 can include one or more fluorescent lamps (e.g., CCFLs) used in a backlight system for LCD applications. The first control stage (or power delivery stage) operates in voltage-mode and includes a first polarity-switching network coupled to a main power (or voltage) transformer 102. The second control stage operates in current-mode and includes a second polarity-switching network coupled to a plurality of balancing transformers shown as balancing transformers 108(1)–108(10) (collectively the balancing transformers 108).

In one embodiment, a common set of control (or driving) signals (e.g., A, B) controls the first polarity-switching network and the second polarity-switching network to deliver power to the lamp loads 100. The first polarity-switching network is coupled to a primary side of the voltage transformer 102. A secondary winding of the voltage transformer 102 has a first terminal coupled to first ends of the lamp loads 100 and a second terminal coupled to first terminals of secondary windings (T1A, T2A . . . T10A) of the balancing transformers 108. Second terminals of the secondary windings of the balancing transformers 108 are coupled to the respective lamp loads 100. Thus, each of the lamp loads 100 is associated with a different one of the balancing transformers 108. Each lamp load 100 is coupled across a series combination of the secondary winding of the voltage transformer 102 and the secondary winding of the associated balancing transformer 108. Primary windings (T1B, T2B . . . T10B) of the balancing transformers 108 are coupled in series across outputs of the second polarity-switching network.

The first polarity-switching network and the second polarity switching network are each implemented with at least two electronic switches (or semiconductor switches). The semiconductor switches can be P-type or N-type transistors (e.g., bipolar junction transistors or field-effect-transistors). In the embodiment shown in FIG. 1A, the first polarity-switching network includes two semiconductor switches (or switching transistors) 104, 106 arranged in a push-pull topology. For example, the semiconductor switches 104, 106 are N-type metal-oxide-semiconductor field-effect-transistors (N-MOSFETs). The first semiconductor switch 104 has a drain terminal coupled to a first terminal of a primary winding of the voltage transformer 102, a source terminal coupled to a reference terminal (e.g., circuit ground) and a gate terminal coupled to a first driving signal (A). The second semiconductor switch 106 has a drain terminal coupled to a second terminal of the primary winding of the voltage transformer 102, a source terminal coupled to circuit ground and a gate terminal coupled to a second driving signal (B). A supply voltage (or voltage source) is provided to a center-tap of the primary winding of the transformer 102.

In one embodiment, the driving signals (A, B) are 50% duty cycle signals that are alternately active. Thus, the first semiconductor switch 104 and the second semiconductor switch 106 are alternately on to couple the supply voltage (e.g., +12 VDC) in alternating polarities across the primary winding of the voltage transformer 102. A corresponding partial AC lamp voltage (Vlamp1) is generated across the secondary winding of the voltage transformer 102. The magnitude of the partial AC lamp voltage is a function of the transformer turns ratio of the voltage transformer 102. The partial AC lamp voltage alone is not sufficient to turn on the lamp loads 100.

In the embodiment shown in FIG. 1A, the second polarity-switching network (or balancing drive switching network) includes four semiconductor switches 114, 116, 118, 120 arranged in a full-bridge topology. For example, the third and the fourth semiconductor switches 114, 116 are P-type MOSFETs while the fifth and the sixth semiconductor switches 118, 120 are N-MOSFETs. The third semiconductor switch 114 has a source terminal coupled to an input current source, a drain terminal coupled to a first output of the second polarity-switching network and a gate terminal coupled to the first driving signal. The fourth semiconductor switch 116 has a source terminal coupled to the input current source, a drain terminal coupled to a second output of the second polarity-switching network and a gate terminal coupled to the second driving signal. The fifth semiconductor switch 118 has a source terminal coupled to circuit ground, a drain terminal coupled to the first output of the second polarity-switching network and a gate terminal coupled to the first driving signal. The sixth semiconductor switch 120 has a source terminal coupled to circuit ground, a drain terminal coupled to the second output of the second polarity-switching network and a gate terminal coupled to the second driving signal.

As described above, the primary windings of the balancing transformers 108 are coupled in series between the first output and the second output of the second polarity-switching network. The primary windings of the balancing transformers 108 conduct approximately equal currents because of the serial connection. The third semiconductor switch 114 and the sixth semiconductor switch 120 conduct as a first pair of semiconductor switches to allow the input current source to flow in a first polarity (or direction) through the serially-connected primary windings of the balancing transformers 108. The fourth semiconductor switch 116 and the fifth semiconductor switch 118 conduct as a second pair of semiconductor switches to allow the input current source to flow in a second (or opposite) polarity through the serially-connected primary windings of the balancing transformers 108.

An AC driving current is generated in the primary windings of the balancing transformers 108 by alternating conduction between the first pair and the second pair of semiconductor switches. Corresponding AC lamps currents flow through the respective secondary windings of the balancing transformers 108. The amplitudes of the AC lamp currents is inversely proportional to the respective transformer turns ratios of the balancing transformers 108. In one embodiment, the transformer turns ratios are approximately the same for each of the balancing transformers 108 and the lamp loads 100 conduct AC lamp currents with approximately the same amplitude. In other embodiments, the transformer turns ratios are different to facilitate different AC lamp current levels for different lamp loads 100. The secondary windings of the balancing transformers 108 provide respective additional (or incremental) lamp voltages, that when added to the partial lamp voltage across the secondary winding of the voltage transformer 102, supports the flow of the corresponding AC lamp currents in the respective lamp loads 100. The balancing transformers 108 function both to balance currents among the lamp loads 100 and to provide additional driving voltages to the lamp loads 100.

In one embodiment, the first control stage is continuously active and provides a portion of the power (or bias power) to all of the lamp loads 100. The bias power is desirably a majority of the operating power but is insufficient by itself to light the lamp loads 100. For example, the first control stage drives the voltage transformer 102 to provide a partial lamp voltage that is about 70–85% (e.g., approximately ¾) of the operating lamp voltage for the lamp loads 100. Fluorescent lamps (e.g., CCFLs) have non-linear current vs. voltage characteristics. The partial lamp voltage alone advantageously does not cause significant current to flow in (or turn on) any of the lamp loads 100 under various conditions (e.g., life of the lamp, temperature variation, manufacturing variation, etc.).

The second control stage provides the remaining (or incremental) power to light the lamp loads 100. For example, the addition of incremental lamp voltages to the partial lamp voltage allows the respective AC lamp currents to flow in the lamp loads 100. The incremental power is advantageously a small portion of the total lamp power. For example, the incremental power can be approximately ¼ of the total power (e.g., about 1.5 watts of a 6 watts lamp). Thus, components in the second control stage (e.g., the balancing transformers 108 and the semiconductor switches 114, 116, 118, 120) can be relatively small and inexpensive.

In one embodiment, the input current source for the second control stage is generated by a current regulator 110 with a series inductor 112 and no capacitor at its output. For example, the current regulator 110 can be a clocked or hysteretic switching regulator with an input coupled to the supply voltage (e.g., +12 VDC). In one embodiment, the current regulator 110 produces a substantially constant input current source that, when referred to the lamp loads 100 by the transformer turns ratios of the balancing transformers 108, corresponds to a desired current level for a predetermined (or maximum) brightness of the lamp loads 100. The brightness of the lamp loads 100 can be varied (or dimmed) by adjusting the level of the input current source.

The lamp loads 100 can be driven in a floating configuration. Alternately, the voltages across the lamp loads 100 can have a direct connection to a ground reference. For example, a ground reference (e.g., a display panel ground) can be connected to the first ends of the lamp loads 100 or the first terminal of the secondary winding of the voltage transformer 102. A second location for connecting a ground reference is at the second terminal of the secondary winding of the voltage transformer 102 (or the first terminals of the secondary winding of the balancing transformers 108. The second location advantageously reduces insulation requirements (and thus size) for the balancing transformers 108.

Although FIG. 1A shows ten lamp loads 100, the incremental distributed driver is not limited to powering ten lamp loads. For example, the number of balancing transformers 108 can be increased or decreased to accommodate more or less lamp loads 100. Furthermore, the first polarity-switching network can be implemented using other switching configurations (e.g., half-bridge or full-bridge topologies) rather than the push-pull topology shown in FIG. 1A. Similarly, other switching configurations (e.g., half-bridge topology) are possible to implement the second polarity-switching network.

Figure 1B:
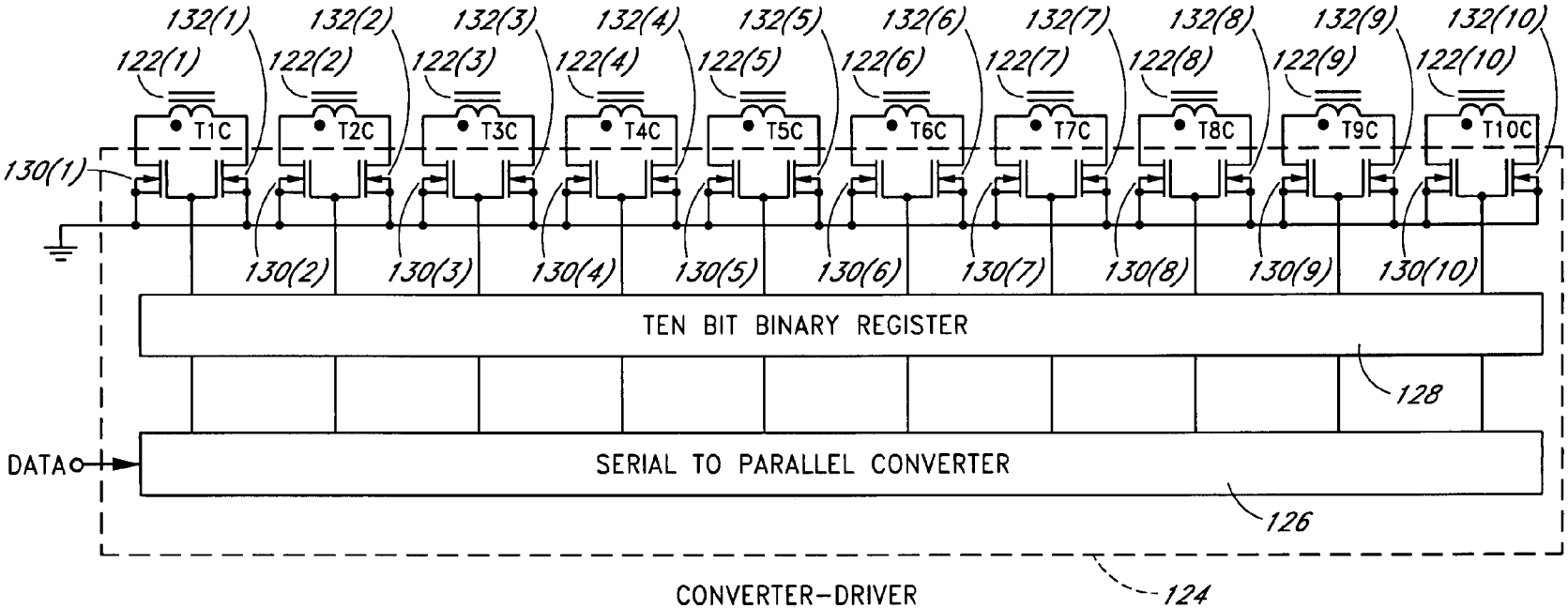
FIG. 1B illustrates one embodiment of additional circuitry used by the incremental distributed driver to accomplish lamp-by-lamp control.

FIG. 1B illustrates one embodiment of additional circuitry used by the incremental distributed driver to accomplish lamp-by-lamp (or individual lamp) control. For example, third windings (T1C, T2C . . . T10C) shown as third windings 122(1)–122(10) (collectively the third windings 122) are respectively added to the balancing transformers 108. The third windings 122 can be shorted to reduce the incremental lamp voltages (or the AC lamp currents) in the secondary windings of the corresponding balancing transformers 108 and effectively turn off the associated lamp loads 108.

The third windings 122 can be shorted individually or in groups. In one embodiment, a pair of semiconductor switches (or electronic shorting switches) is coupled between a reference node (e.g., circuit ground) and respective opposite terminals of each of the third windings 122 to facilitate the shorting function. For example, a first set of semiconductor switches (e.g., N-MOSFETs) shown as semiconductor switches 130(1)–130(10) (collectively the first set of semiconductor switches 130) have source terminals coupled to circuit ground and drain terminals coupled to first terminals of the respective third windings 122. A second set of semiconductor switches (e.g., N-MOSFETs) shown as semiconductor switches 132(1)–132(10) (collectively the second set of semiconductor switches 132) have source terminals coupled to circuit ground and drain terminals coupled to second terminals of the respective third windings 122. Gate terminals of semiconductor switches associated with a common third winding 122 are commonly coupled to receive a shorting signal (or dimming command).

In one embodiment, the semiconductor switches 130, 132 are low voltage and low power devices (e.g., rated for operation at approximately 5–24 volts or switching approximately 1.5 watts of power at about 12 volts). The semiconductor switches (or bank of shorting switches) 130, 132 can be part of an integrated circuit and driven at relatively low ground-referenced levels. For example, N-MOSFETs in integrated circuits can switch about 0.3 amperes at approximately 5 volts. The number of turns for each of the third windings 122 depends in part on the voltage rating of the semiconductor switches 130, 132. In one embodiment, the third windings 122 have approximately 1–24 turns each to support a spectrum of voltage ratings. Less number of turns (e.g., 1–6 turns) is used to support integrated circuit semiconductor switches with relatively lower voltage ratings (e.g., 5–12 volts). Higher number of turns (e.g., 20–24 turns) is used to support discrete semiconductor switches with relatively higher voltage ratings (e.g., 40 volts).

Using a plurality of balancing transformers 108 to distribute power to the lamp loads 100 in the second power delivery stage advantageously facilitates control (e.g., turning on/off or dimming) of individual lamp loads 100. Thus, the second power delivery stage can control delivery of all power to the lamp loads 100 while delivering a relatively small portion of the total power to the lamp loads 100. As described in FIG. 1A, the current regulator 110 providing the input current source to the serially-connected primary windings of the balancing transformers 108 to generate the AC lamp currents in the secondary windings of the balancing transformers 108 has the series inductor 112 and no capacitor at its output. The series inductor 112 provides a compliance voltage that can change as different numbers of lamp loads 100 are turned on/off. For example, when one or more of the third windings 122 are shorted, the total voltage across the serially-connected primary windings decreases and the current regulator 110 delivers less total power (e.g., same current at reduced voltage) to the lamp loads 100. The number of turns for the primary windings of the balancing transformers 108 is limited by the supply voltage to the current regulator 110 (or available compliance voltage across the series inductor 112). In one embodiment, the primary windings of the balancing transformers 108 are a single turn each.

Dimming of the lamp loads 100 can be accomplished by reducing the duty cycle of the AC lamp currents in the secondary windings of the balancing transformers 108. For example, the duty cycle of the AC lamp currents can be reduced by shorting the third windings 122 for a predetermined time during each half-cycle of the driving signals for the first polarity-switching network and the second polarity-switching network. Alternately, the lamp loads 100 can be dimmed by periodically shorting the third windings 122 for a predetermined number of cycles of the driving signals. In one embodiment, the brightness of each lamp load 100 is adjusted in accordance with an average brightness of LCD pixels in that part of the screen for image enhancement. For example, the intensity of the lamp loads 100 (or backlight) is desirably decreased to enhance relatively dark pixels or increased to enhance relatively bright pixels.

In one embodiment, the third windings 122 can be shorted in synchronism with a vertical sweep of an image/video down a display screen to provide blanking (or turning off) of lamps that advances lamp-by-lamp or by banks of lamps to reduce motion artifact. For example, a dimming controller can send a serial change message (or a digital word) at predetermined intervals (e.g., every 1–20 microseconds) to control which lamp loads 100 are lit (or turned off) for a subsequent interval. In the embodiment shown in FIG. 1B, the digital word (DATA) is provided to a serial-to-parallel converter (e.g., a shift register with an output enable) 126 with outputs coupled to a binary register 128. The binary register 128 outputs logic signals to drive the semiconductor switches 130, 132.

The binary register 128 is generally updated faster than the operating frequency of the lamp loads 100 to facilitate general dimming. The binary register 128 is updated at or above a vertical sweep frequency associated with image/video updates to facilitate reduction of motion artifact. In one application that controls general dimming functions by adjusting the output of the current regulator 110, the serial-to-parallel converter 126 is a simple shift register with an input clock rate that is approximately equal to a product of the vertical sweep frequency and the number of lamp loads (or lamps) 100. In this case, the serial-to-parallel converter (or shift register) 126 operates at a relatively slow speed for an off state driving a blanked bank of lamps to proceed down the shift register in synchronism with a vertical sweep of image/video provided to a LCD. For example, in an application with 20 lamps and a vertical sweep frequency of 200 Hertz, the input clock rate of the shift register is approximately 4 Kilo-Hertz while the operating frequency of the lamp loads 100 is approximately 40 Kilo-Hertz.

In one embodiment, the serial-to-parallel converter 126, the binary register and the semiconductor switches 130, 132 are part of a common integrated circuit (e.g., a converter-driver) 124 that shorts the third windings 122 in accordance with instructions from the dimming controller. The dimming controller can be part of a digital control system for the LCD. The dimming controller can select a group of lamps to blank, and blanking within the selected group can be advanced lamp-by-lamp down the face of a visual display in synchronism with a vertical sweep of images/video. For example, the lamp loads (or lamps) 100 are placed horizontally in a backlight panel and images are updated by sweeping from the top of a display screen to the bottom of the display screen. The dimming controller can also control dimming of the lamp loads 100, when lit, in conformance with the image/video brightness in that part of the display.

Various embodiments have been described above. Although described with reference to these specific embodiments, the descriptions are intended to be illustrative and are not intended to be limiting. Various modifications and applications may occur to those skilled in the art without departing from the true spirit and scope of the invention as defined by the appended claims.

What is claimed is:

1. An inverter for powering multiple lamps in a backlight system, the inverter comprising:

a voltage-mode power stage configured to provide a partial operating voltage to the lamps, wherein the voltage-mode power stage comprises a first polarity-switching network coupled to a voltage transformer; and a current-mode power stage configured to control current levels for each of the lamps and to provide additional operating voltages to the respective lamps to achieve corresponding desired current levels, wherein the current-mode power stage comprises a second polarity-switching network coupled to a plurality of balancing transformers.

2. The inverter of claim 1, wherein the voltage-mode power stage delivers approximately 70–85% of the power and the current-mode power stage delivers the remaining power to the lamps.

3. The inverter of claim 1, wherein the first polarity-switching network and the second polarity-switching network are controlled by a common set of driving signals from a controller.

4. The inverter of claim 1, wherein the first polarity-switching network comprises at least two semiconductor switches arranged in a push-pull topology, a half-bridge topology or a full-bridge topology to couple a substantially DC voltage source in alternating polarities across a primary side of the voltage transformer.

5. The inverter of claim 1, wherein the second polarity-switching network comprises at least two semiconductor switches arranged in a half-bridge or a full-bridge topology to couple a substantially DC current source in alternating polarities to serially-connected primary windings of the balancing transformers.

6. The inverter of claim 1, wherein the first polarity-switching network comprises at least two semiconductor switches that alternately conduct to generate the partial operating voltage across a secondary winding of the voltage transformer, the secondary winding of the voltage transformer has a first terminal for coupling to first ends of the lamps and a second terminal for coupling to an intermediate node, the second polarity-switching network comprises at least two semiconductor switches that alternately conduct to generate an AC current signal, and the balancing transformers have first windings coupled in series to conduct the AC current signal and second windings for individual coupling between the intermediate node and respective second ends of the lamps.

7. The inverter of claim 1, wherein each of the balancing transformers have three windings and the inverter further comprises a bank of shorting switches to selectively short one or more third windings of the balancing transformers to turn off the associated lamps.

8. The inverter of claim 7, wherein the lamps illuminate a liquid crystal display and the lamps are sequentially turned off in synchronism with a vertical sweep of display image for the liquid crystal display.

9. The inverter of claim 7, wherein the lamps are periodically turned off to reduce brightness of the lamps.

10. The inverter of claim 7, wherein a dimming controller periodically sends a digital word to control the bank of shorting switches.

11. The inverter of claim 1, wherein the current-mode power stage further comprises a current regulator configured to generate a substantially DC current source for the second polarity-switching network.

12. The inverter of claim 11, wherein brightness of the lamps is adjusted by varying the level of the substantially DC current source.

13. A method to power multiple lamp loads in a backlight system, the method comprising:

providing a partial operating voltage to the lamp loads using a first polarity-switching network and a voltage transformer; and regulating current levels for each of the lamp loads and providing additional operating voltages to the respective lamp loads using a second polarity-switching network and multiple balancing transformers, wherein each of the balancing transformers is associated with a different lamp load.

14. The method of claim 13, further comprising controlling the first polarity-switching network and the second polarity switching network with a common set of approximately 50% duty cycle driving signals.

15. The method of claim 13, wherein the balancing transformers have approximately equal transformer turns ratios with primary windings coupled in series to conduct a common AC driving current and secondary windings separately coupled to the respective lamp loads.

16. The method of claim 15, wherein the primary windings of the balancing transformers are a single turn each.

17. The method of claim 13, wherein each of the balancing transformers comprise three windings and the method further comprises selectively turning off one or more of the lamp loads by electrically shorting third windings of the associated balancing transformers.

18. The method of claim 17, wherein the third windings are approximately 1–24 turns each.

19. An inverter comprising:

means for providing a partial operating voltage to a plurality of lamps; and means for regulating current levels for each of the lamps and providing corresponding incremental operating voltages that are combined with the partial operating voltage to power the respective lamps.

20. The inverter of claim 19, further comprising means for selectively shorting one or more of the incremental operating voltages to turn off the associated lamps.

* * * * *